US006988638B2

(12) United States Patent
Zak

(10) Patent No.: US 6,988,638 B2
(45) Date of Patent: Jan. 24, 2006

(54) TOOTHPASTE DISPENSING FIGURINE

(76) Inventor: Marc Zak, 37440 Fawn Path Dr., Solon, OH (US) 44139

( * ) Notice: Subject to any disclaimer, the term of this patent is extended or adjusted under 35 U.S.C. 154(b) by 552 days.

(21) Appl. No.: 09/946,244

(22) Filed: Sep. 5, 2001

(65) Prior Publication Data

US 2004/0020939 A1 Feb. 5, 2004

(51) Int. Cl.
*B67D 3/018* (2006.01)

(52) U.S. Cl. ..... 222/78; 222/102; 222/214

(58) Field of Classification Search ..... 222/78, 222/102, 207, 214, 257, 79
See application file for complete search history.

(56) References Cited

U.S. PATENT DOCUMENTS 3,105,612 A * 10/1963 Krasnoff et al. ..... 222/78
3,178,060 A * 4/1965 Bossack ..... 222/78
3,275,195 A * 9/1966 Reinstra ..... 222/102
4,010,870 A * 3/1977 Wilson ..... 222/78
4,570,829 A * 2/1986 Allen ..... 222/207
5,482,187 A * 1/1996 Poulsen et al. ..... 222/207

FOREIGN PATENT DOCUMENTS

JP 406100058 A * 4/1994

* cited by examiner

*Primary Examiner*—Gene Mancene
*Assistant Examiner*—Melvin A. Cartagena

(57) ABSTRACT

A dispensing figurine formed in the image of at least a portion of a being or some other non-cap object. The dispenser figurine of the present invention preferably includes a body, at least a portion of which has an outward appearance in the form of a portion of a being or some other non-cap object, means for attaching the dispenser figurine to a tube of toothpaste (or a tube of some other gel or paste), a conduit extending through the body through which the toothpaste passes, and an exit port through which the paste (or gel) is dispensed or otherwise exits the dispenser figurine.

12 Claims, 12 Drawing Sheets

TOOTHPASTE DISPENSING FIGURINE

FIELD OF THE INVENTION

The present invention generally relates to health and beauty aids and more specifically to a toothpaste dispensing figurine having the external appearance of at least a portion of a being, e.g., at least a portion of an action figure, or having the external appearance of at least a portion of some other non-cap object, e.g., a vehicle or at least a portion of a vehicle.

BACKGROUND OF THE INVENTION

Toothpaste tubes typically include a mechanism allowing the tube to be repeatedly opened to dispense the paste and closed to prevent the paste from drying out or being inadvertently dispensed. Various closure mechanisms have been developed for that purpose, including threaded caps and lids, flip-top caps, self-opening and closing pumps, and valves or apertures that open, allowing paste to flow when the tube is squeezed, advanced by a threaded diaphragm, or forced by a plunger, etc. As used herein, the term "toothpaste" means toothpaste and/or or tooth gel as those terms are commonly understood, as well as other pastes and gels used to assist the cleaning and/or whitening and/or polishing of one's teeth.

The vast majority of the known prior art toothpaste dispenser closure mechanisms are purely functional in nature and have a utilitarian look to them. At most they may have design characteristics that make them more attractive or effective as a closure mechanism.

SUMMARY OF THE INVENTION

The present invention is directed toward a toothpaste dispenser figurine having an outward appearance of a being, such as an action figure, a person (e.g., a historical figure or a sports personality), an animal, or a fictional character or creature, or a portion of a being, such as a head portion, a bust portion, etc. In a more general sense, the present invention is directed toward a toothpaste dispenser figurine having an outward appearance of an animate or inanimate non-cap object, e.g., a vehicle or a portion of a vehicle. This makes dispensing toothpaste (or some other gel or paste) fun and interesting for the user and provides marketing opportunities for goods and services, such as tying the being represented on the dispenser figurine to various media, e.g., a major motion picture. The term "being" as used herein includes the entity itself and preferably also includes any associated apparel, accessories, gear, equipment, and other accessories. The term "non-cap object" as used herein means any animate or inanimate object that does not have an appearance consisting of one or more of the closure mechanisms listed above, e.g., threaded caps and lids, flip-top caps, self-opening and closing pumps, etc.

The various embodiments of the dispenser figurine of the present invention have in common a body, at least a portion of which has an outward appearance in the form of a portion of a being or some other non-cap object, means for connecting the dispenser figurine to a tube of toothpaste (or a tube of some other gel or paste), a conduit extending through the body through which the toothpaste passes, and an exit port through which the paste (or gel) is dispensed or otherwise exits the dispenser figurine.

BRIEF DESCRIPTION OF THE DRAWINGS

In the accompanying drawings, which are incorporated in and constitute a part of this specification, embodiments of the invention are illustrated. These drawings, together with the general description of the invention given above and the detailed description given below, serve to example the principles of this invention.

FIG. 1A shows a perspective view of the first embodiment completely assembled. FIG. 1B shows a perspective exploded view of the components comprising the first embodiment. FIG. 1C shows a perspective view of the first embodiment in use.

FIG. 2A shows a perspective view of the second embodiment completely assembled. FIG. 2B shows a perspective view of the components comprising the second embodiment. FIG. 2C shows a perspective view of the third embodiment in use.

FIG. 3A shows a perspective view of the third embodiment completely assembled. FIG. 3B shows a perspective view of the components comprising the third embodiment. FIG. 3C shows a perspective view of the third embodiment in use.

DETAILED DESCRIPTION OF THE PREFERRED EMBODIMENTS

Figure 1A:
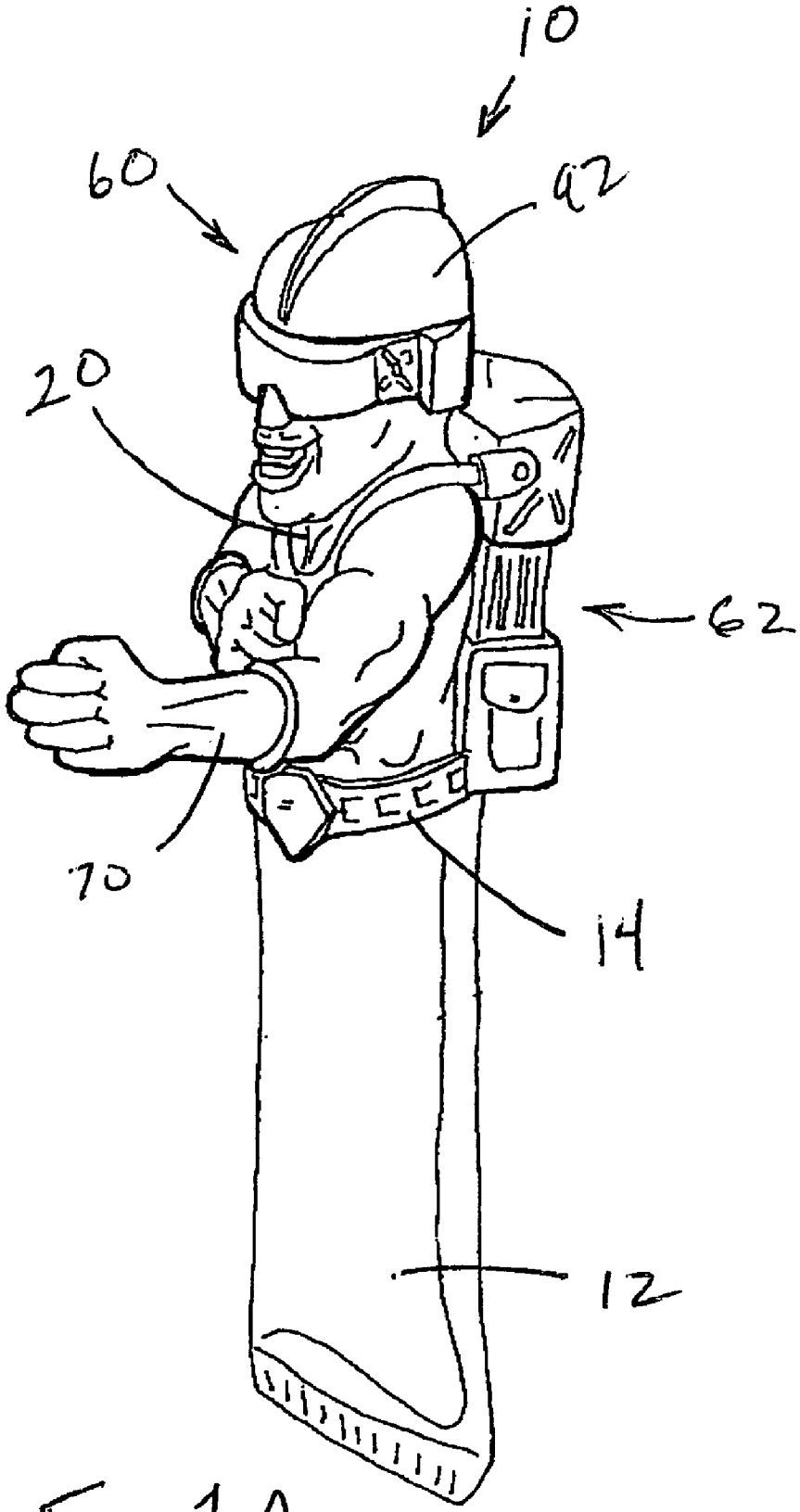
FIGS. 1A–C illustrate a first embodiment of the invention.

The present invention is a dispensing figurine that mates to a tube of toothpaste (or a tube of some other gel or paste). Four different embodiments are shown in FIGS. 1–3 and 5. Like elements are labeled with an identical number among the different figures. All of the various embodiments of the dispensing figurine 10 according to the present invention are constructed to attach to a container 12 at a container end 14. A "figurine" is a small carved or molded figure, such as a statuette, and expressly includes representations of entire beings and, in the alternative, portions thereof, e.g., busts, heads, etc., and also expressly includes representations of other entire non-cap objects (e.g., vehicles) and, in the alternative, portions thereof. The container 12 may be of any conventional type, chosen for its suitability to contain the contents to be dispensed by the figurine, e.g., a tube, box, bag, sack, capsule, canister, or bottle, and is preferably a tube of toothpaste (or a tube of some other gel or paste), including but not limited to free-standing tubes of toothpaste (not shown in the figures) and the more conventional crimped-end tubes of toothpaste (shown in some of the figures).

The dispensing figurine 10 is preferably used to dispense a gel substance 16, which is most preferably toothpaste. Toothpaste is typically contained and sold in a tube as illustrated in the figures. In general, however, the gel substance 16 might be toothpaste, a food item (such as candy paste), bubble gum paste, or glue, or virtually any other paste, foam, viscous liquid, or gel.

The various embodiments of the dispenser figurine 10 of the present invention preferably include a body 20, at least a portion of which has an outward appearance in the form of a portion of a being, an entry port 22 through which the paste or gel enters the body 20, attachment means for attaching the dispenser figurine 10 to a tube 12 of toothpaste (or a tube 12 of some other gel or paste), a dispensing conduit 24 extending through at least a portion of the body 20 through which the toothpaste (or other paste or gel) passes, and an exit port 26 through which the paste or gel is dispensed or otherwise exits the dispensing figurine 10.

The exterior of the body of the figurine 10 is preferably formed in the image of a non-cap object, e.g., a building or a vehicle or a being, or a portion thereof. The represented non-cap object might represent an archetype such as a space ship, an automobile, a truck, a race car, a whale, an airplane, a rocket, a submarine, a boat, a ship, etc. The exterior of the body of the figurine 10 is more preferably formed in the image of a person, animal, creature, or other being, or a portion of a being, such as a head portion, a bust portion, etc. The represented being may for example be an actual being such as a historical figure, sports star, movie star, politician, or a well-recognized animal such as Lassie. The represented being might also be a fictional being, such as an action figure, a movie character, a cartoon character, or a book character, e.g., any of the various PoKéMoN characters. The represented being also might not be any specifically identifiable being, but rather represent an archetype such as an army soldier, porpoise, giraffe, or a fantasy creature.

The figurine may be made from any convenient material and in virtually any convenient manner. It is preferably made of a thermoplastic polymer (e.g., PVC or some of the various styrene-based compounds sold under the KRATON trademark that are suitable for food-grade containers) and formed by injection molding techniques, as is known to those of ordinary skill in the art. It may alternatively be made of other materials. Preferably the material from which the figurine 10 is made will not contaminate the contents of the container 12 dispensed by the figurine 10 and will permit mass production at a relatively inexpensive cost.

Figure 1B:
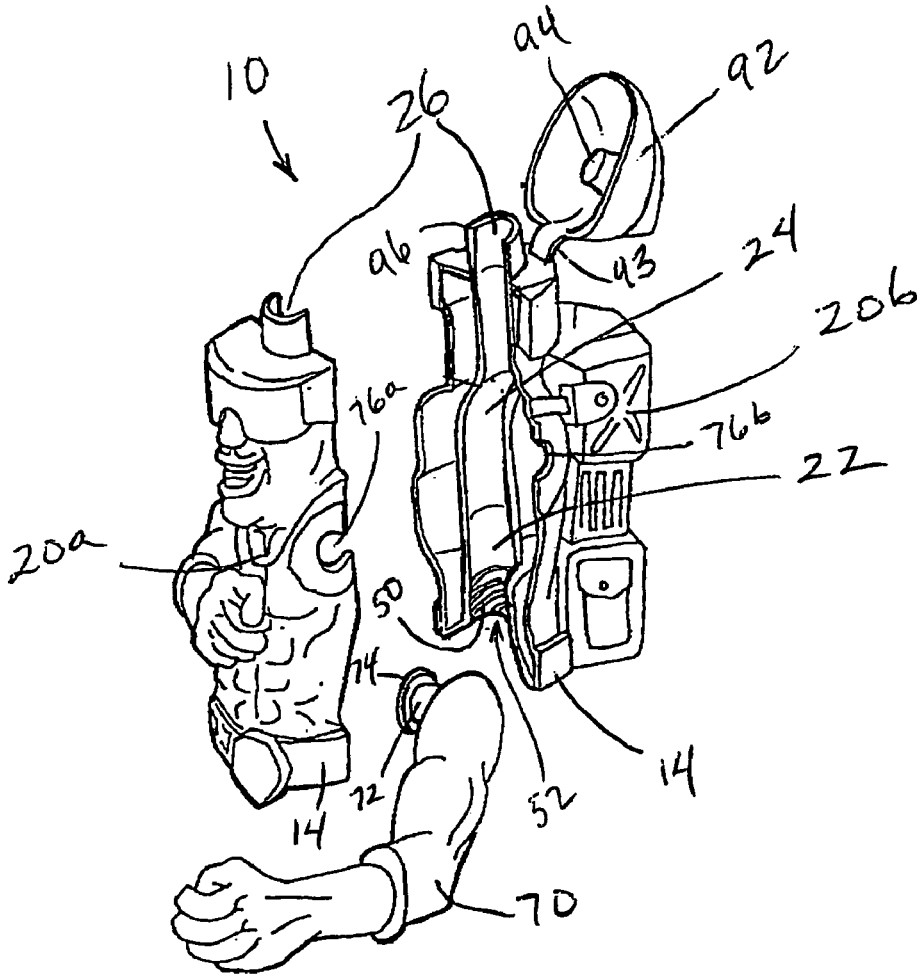
Figure 2A:
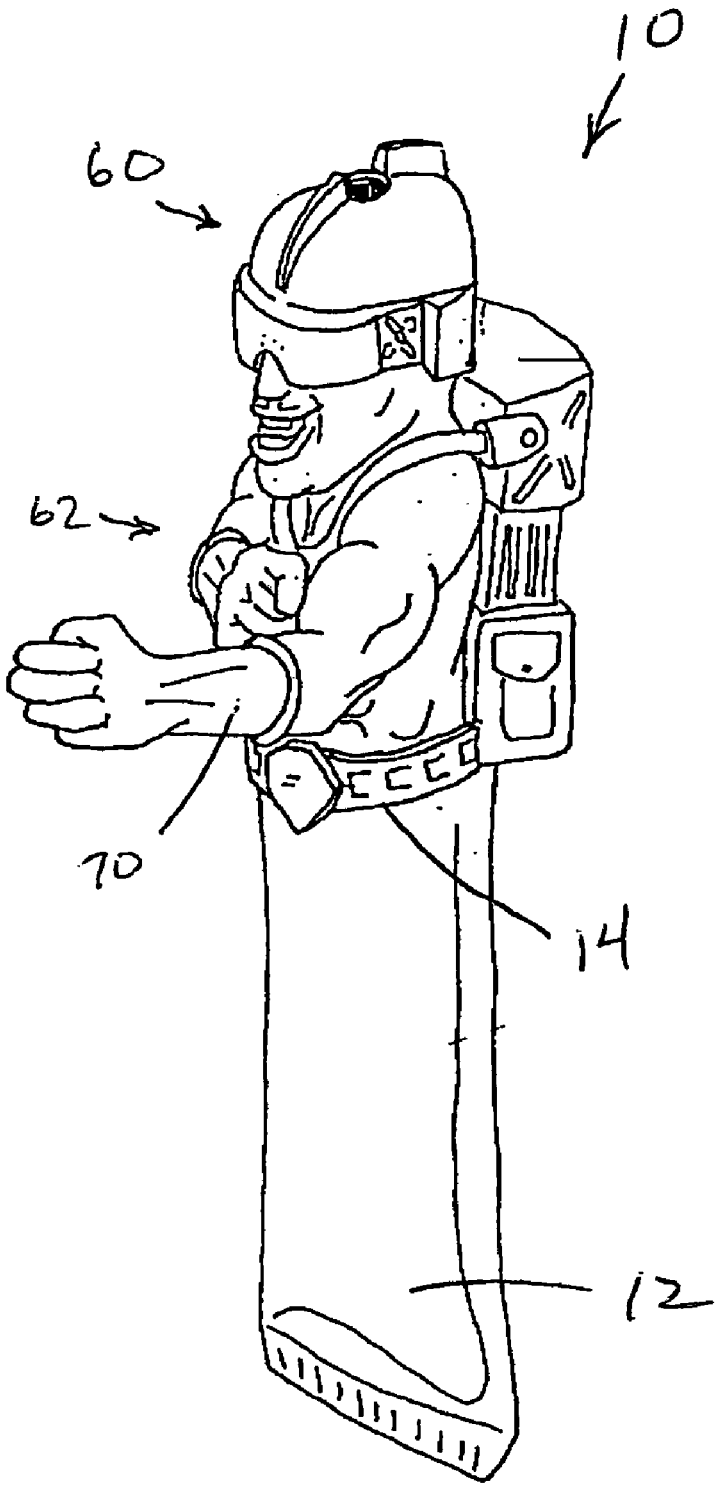
FIGS. 2A–C illustrate a second embodiment of the invention.
Figure 2B:
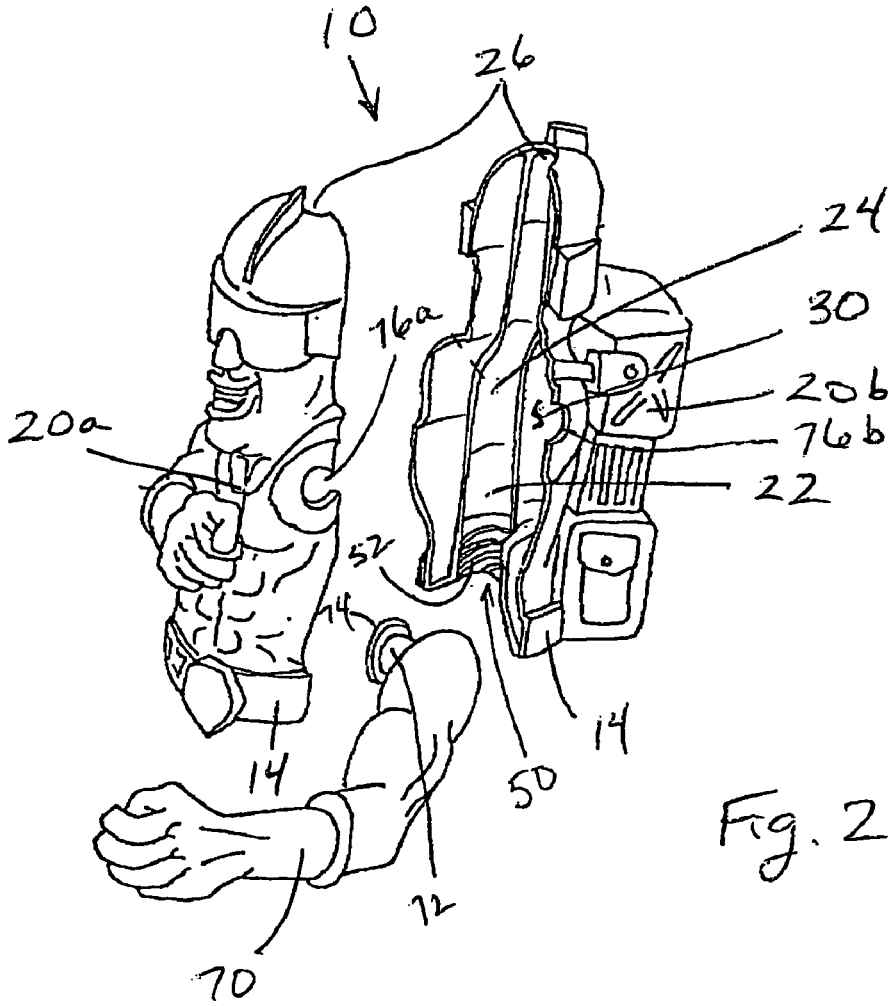
Figure 2C:
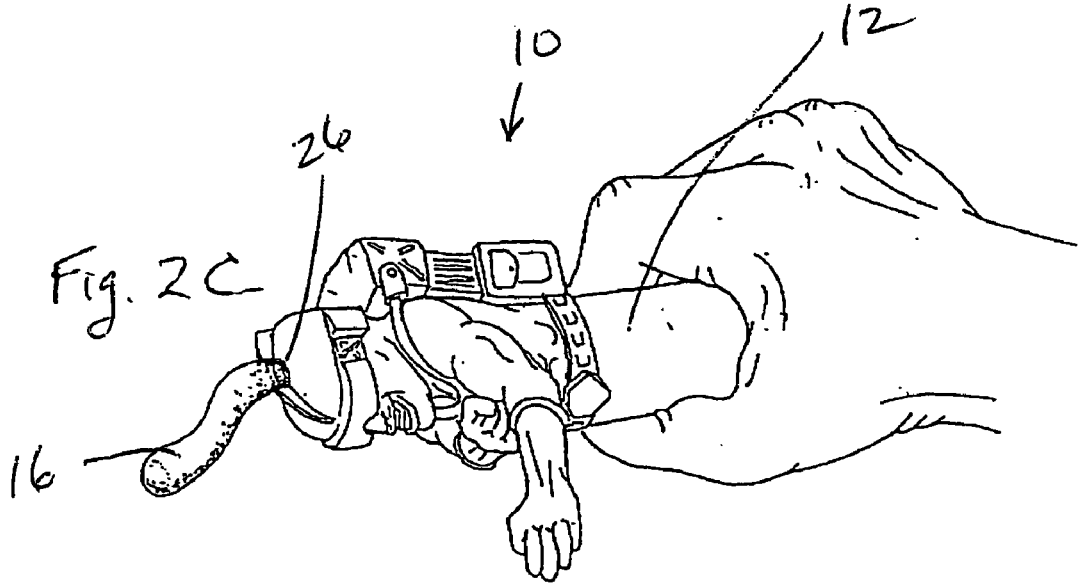
Figure 3A:
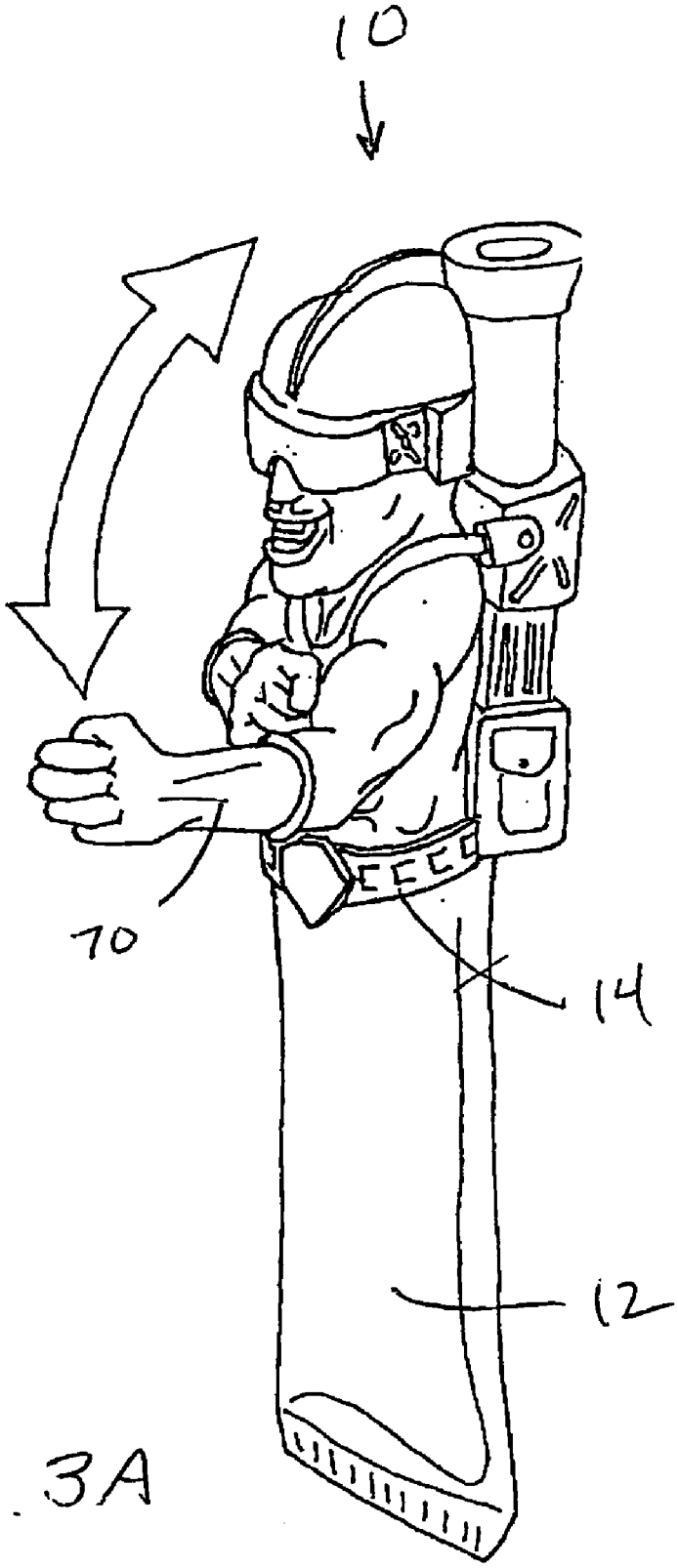
FIGS. 3A–C illustrate a third embodiment of the invention.
Figure 3B:
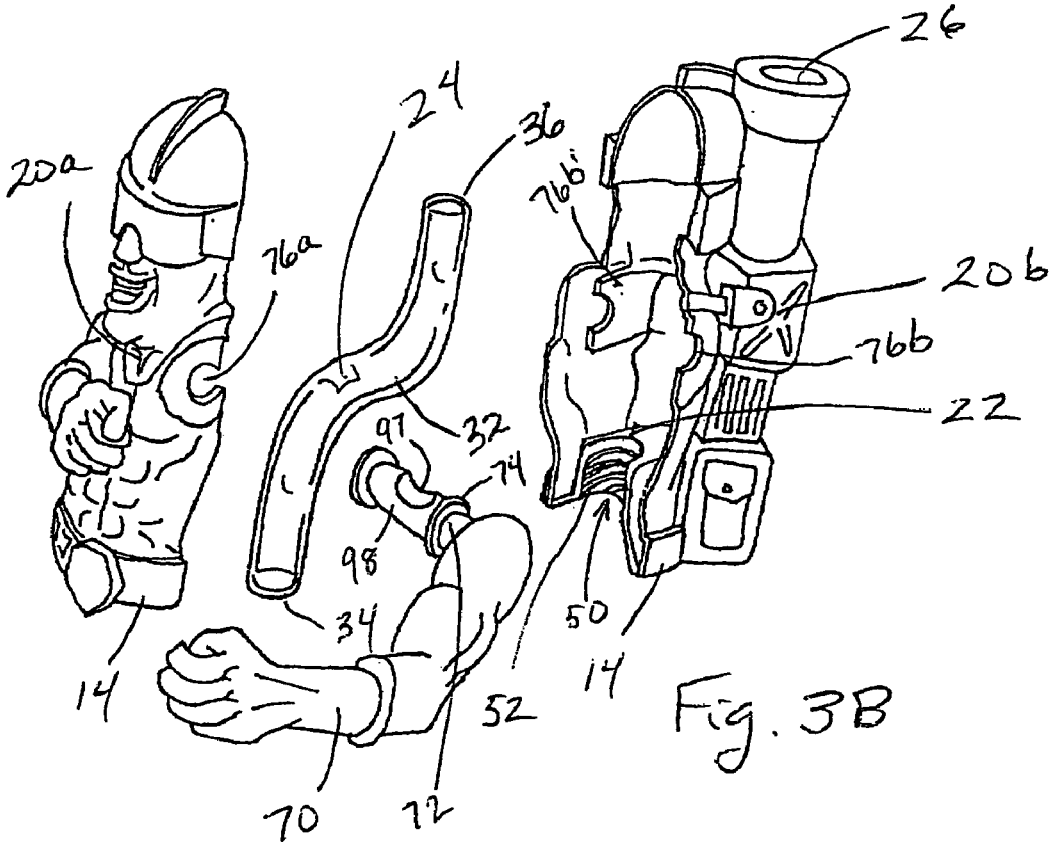

One convenient method of manufacturing a dispensing figurine 10 with a dispensing conduit 24 is to first make the body 20 of the figurine in two halves 20*a* and 20*b* (for example as illustrated in FIGS. 1B, 2B and 3B), which are then affixed together. The halves may be affixed to each other in virtually any conventional manner, such as by ultrasonic welding or with use of an adhesive. The dispensing conduit 24 preferably extends from the entry port 22 of the body 20 of the figurine 10, through the body of the figurine, and to an exit port 26 in the body of the figurine 10. The exit port 26 is preferably but not necessarily located in or near the top of the figurine 10. The dispensing conduit 24 is preferably formed by one or more internal walls 30 integrally formed in each half 20*a*, 20*b* of the body 20. When the halves 20*a*, 20*b* are affixed, the opposing walls 30 on each half 20*a*, 20*b* mate together forming the dispensing conduit 24 through which the paste 26 passes through the body 20 from entry port 22 to exit port 26.

Figure 4:
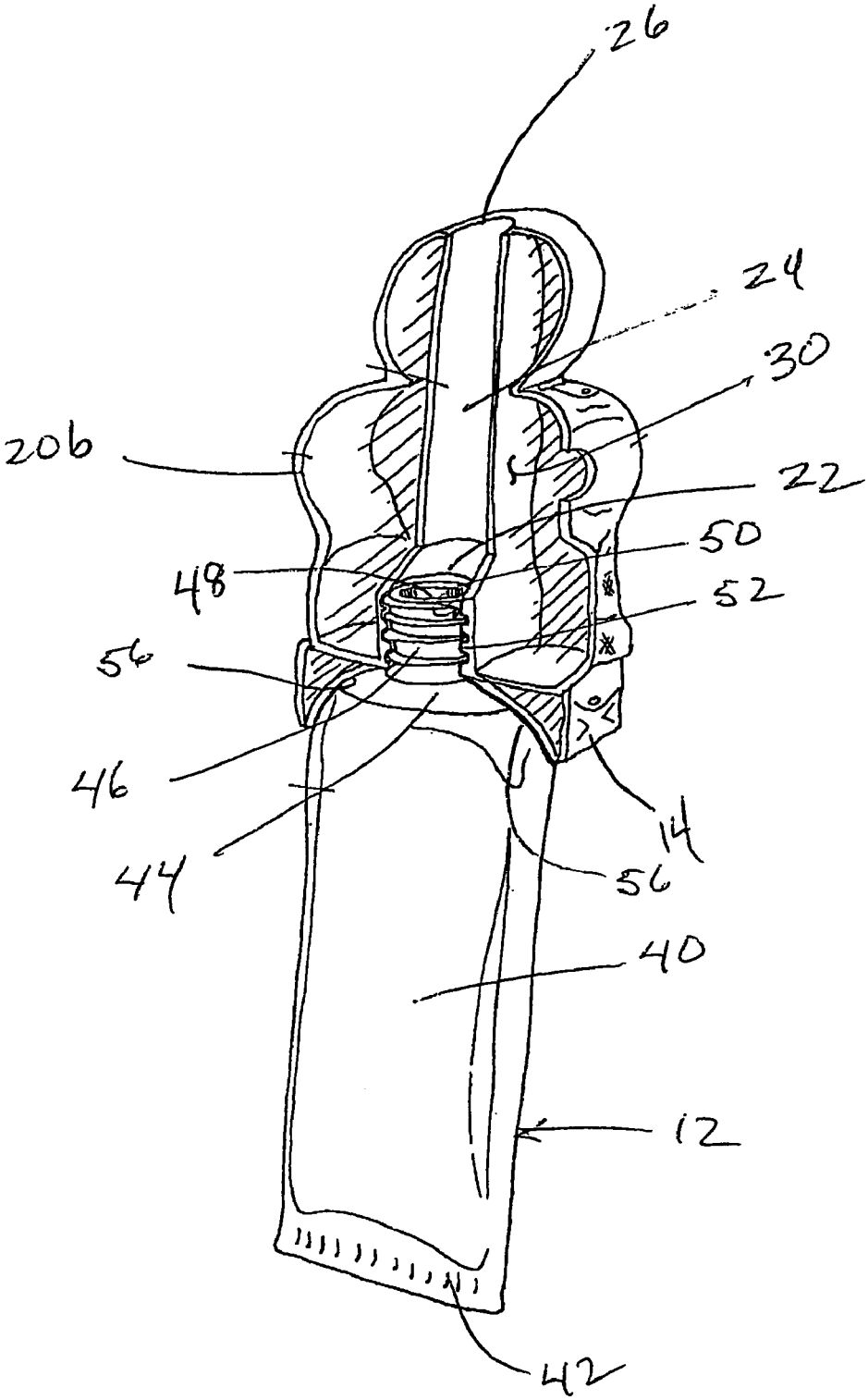
FIG. 4 is a perspective sectional view showing a cutaway portion of a dispensing figurine made in accordance with the second embodiment of the present invention, as mated to a representative tube of toothpaste.

In the alternative, the dispensing conduit 24 may be formed of a separate piece 32, e.g., a piece of flexible tubing 32 (FIG. 3B). If a tube 32 is employed as conduit 24 it is preferably at least somewhat flexible to allow easy assembly of the overall figurine assembly. This alternative has the advantage of easily directing the flow of paste 26 from the entry port 22 to exit port(s) 26 positioned at virtually any location on the body 20, including locations for which forming a conduit 24 with internal wall 30 by injection molding (FIGS. 1B, 2B, and 4) would be problematic at best, and impossible at worst. If the dispensing conduit 24 comprises a separate element from the body 20 of the figurine 10, such as tube 32, it may be first inserted in one half 20*b* of the body 20 of the figurine, and preferably affixed to the entry port 22 at one end 34 and affixed to the exit port 26 at the other end 26 (e.g., using an adhesive or ultrasonic welding), before the two body halves 20*a*, 20*b* are affixed together. The most important aspect of the dispensing conduit 24 is that it places the exit port 26 in fluid communication with the entry port 22, which places the exit port 26 in fluid communication with the exit port 48 of the tube 12 (FIG. 4). This can be done using a number of different structures in addition to or in the alternative to those discussed above, including by way of example having relatively thin-walled body halves 20*a*, 20*b* and using most if not all of the internal volume of the body 20 as a dispensing conduit 24 through which the paste 16 passes from the entry port 22 to the exit port 26.

Figure 6:
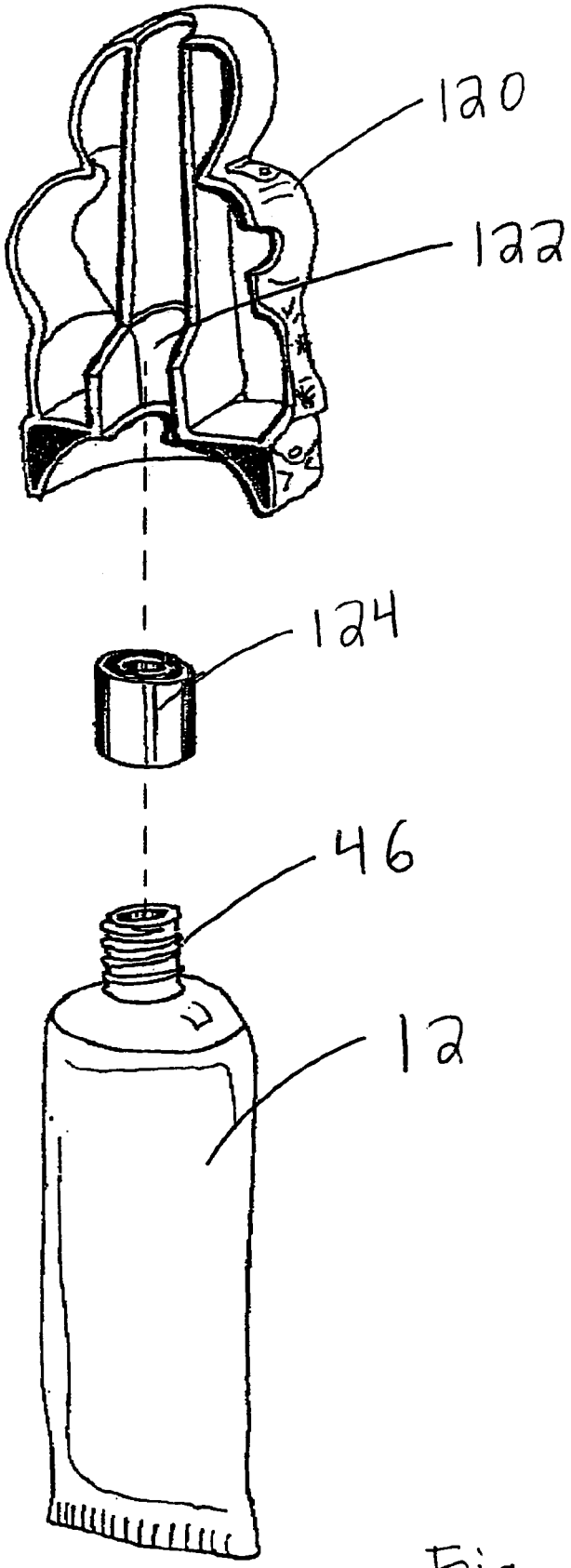
FIG. 6 is a perspective sectional view showing a cutaway portion of a dispensing figurine, showing a body half that accepts any one of a number of different attachment modules providing various attachment means.
Figure 7C:
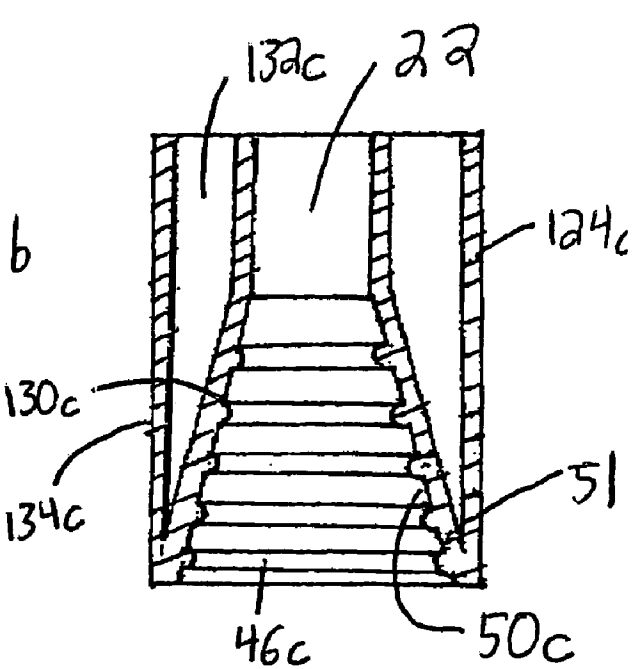
FIGS. 7A–7I show sectional views of various attachment modules providing various means for attaching the dispensing figurine of the present invention to a tube of paste.
Figure 7B:
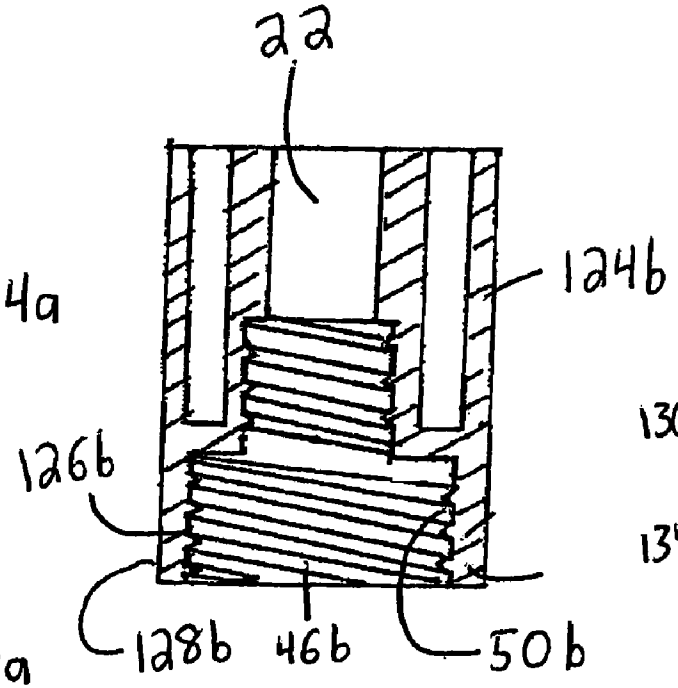
Figure 7A:
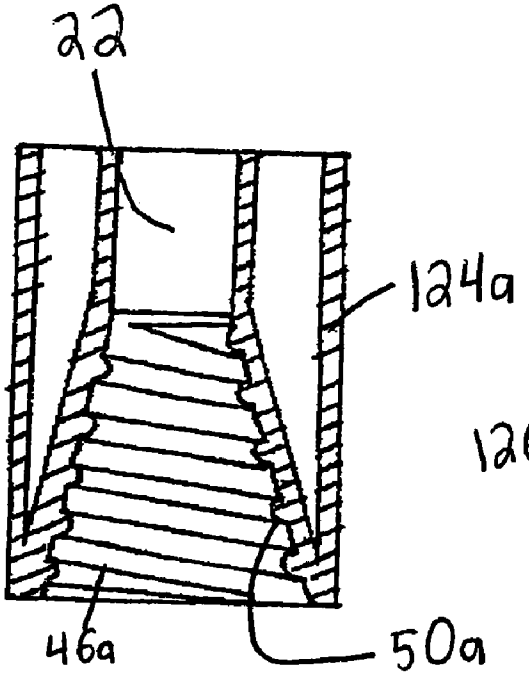

The container end 14 of the dispensing figurine 10 mates with, attaches to, contacts with, or is in fluid communication with, the container 12 using virtually any attachment structure that keeps the two components attached together under normal use and that prevents the contents of the container from leaking from the point of attachment during normal use. One attachment means is illustrated in FIGS. 1B, 2B, 3B, and 4, with the tube 12 shown in FIG. 4 mated to half 20*b* of body 20. The container 12 in FIG. 4 is a common type of tube used to dispense toothpaste, having a hollow tube portion 40 in which the toothpaste or tooth gel is contained, a flattened, crimped end 42, and an opposite end 44 (typically frustoconical in shape) having a slightly tapered, threaded projection 46. Projection 46 has an exit port 48 through which the paste or gel is typically dispensed from the tube 12), and ordinarily accepts a slightly tapered, threaded cap having mating threads on an internal surface and having a knurled external surface (not shown). The attachment means in FIGS. 1B, 2B, 3B, and 4 is a threaded, internal surface 50 of the body 20 proximate (and preferably forming) entry port 22 that is sized to match and having threads 52 that correspond to operate with the threaded projection 46 of the toothpaste tube 12. The threaded, internal surface 50 is preferably, but not necessarily, slightly tapered to match the slight taper of the threaded projection 46 of tube 12. The threaded, internal surface 50 is preferably positioned adjacent the entry port 22. The threaded, internal surface 50 may be made of a relatively rigid material, but is preferably made of a compliant (slightly elastic) material, such as PVC or another thermoplastic polymer that is suitable for food-grade containers, e.g., some of the various compliant styrene-based compounds sold under the KRATON trademark that are suitable for food-grade containers. The threaded, internal surface 50 is preferably sized, tapered, and threaded to match commonly used tubes 12; however, in the alternative, the internal surface 50 can be preferably sized and tapered, and even potentially threaded, to accept, attach to, and form an acceptable seal (without an excessive amount of paste of gel escaping during use) with a number of differently sized, tapered, and/or threaded tubes 12. The level of compliance (i.e., the level of elasticity) of the material chosen to form the threaded, internal surface 50 will affect the ability of the threaded, internal surface 50 to be suitably used with differently sized, tapered, and/or threaded tubes 12. The threaded, internal surface 50 is preferably part of and made integrally with the body 20, with half of the threaded, internal surface 50 preferably being injection molded into each half 20*a*, 20*b* of the body 20. FIG. 7A shows an example of a threaded, tapered surface 50*a* that can function as an attachment means. FIG. 7B shows an example of a threaded, stepped surface 50*b* that can function as an attachment means. The surfaces described in this paragraph can be, but need not necessarily be, integrally formed with the halves 20*a*, 20*b* of body 20 using either the same material or a different material, or separately formed via an attachment module (FIGS. 6 and 7A–7I) using either the same material or a different material as the halves 20*a*, 20*b*.

Figure 7F:
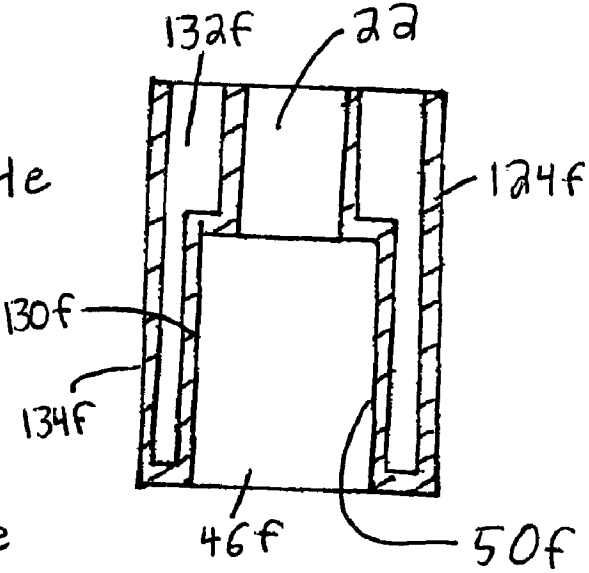
Figure 7E:
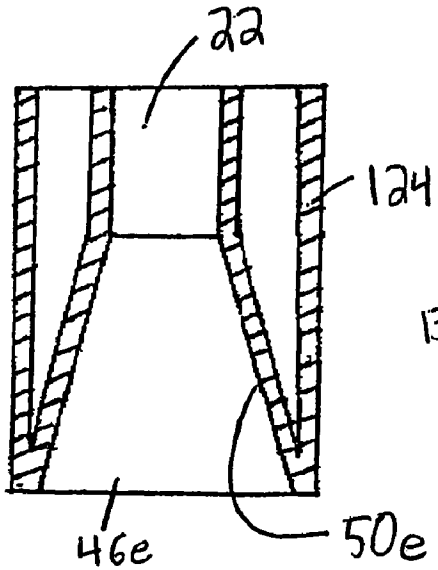
Figure 7D:
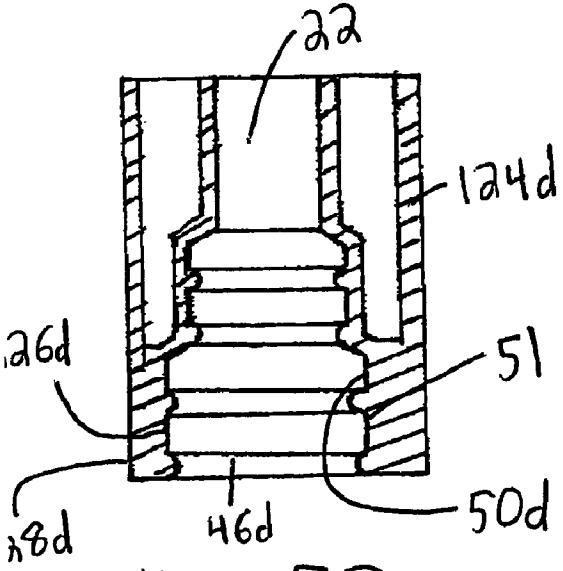

In the alternative to the threaded, internal surface 50, the attachment means can be an internal surface having one or more internal flanges or ridges or the like, similar in cross-section to threads, and that engage at least a portion of the threads of a threaded extension 46. Like the internal threaded surface 50 discussed above, this alternative internal surface is preferably, but not necessarily, slightly tapered to match the slight taper of the threaded projection 46 of tube 12. There is preferably, but not necessarily, a plurality of such internal flanges or ridges, which are preferably, but not necessarily, continuous and concentric. This alternative internal surface is preferably made of a compliant material, such as PVC or another thermoplastic polymer that is suitable for food-grade containers, e.g., some of the various compliant styrene-based thermoplastic elastomers sold under the KRATON trademark that are suitable for food-grade containers. FIG. 7C shows an example of a tapered surface 50*c* having a plurality of concentric flanges 51 that can function as an attachment means. FIG. 7D shows an example of a stepped surface 50*d* having a plurality of concentric flanges 51 that can function as an attachment means. The surfaces described in this paragraph can be, but need not necessarily be, integrally formed with the halves 20*a*, 20*b* of body 20 using either the same material or a different material, or separately formed via an attachment module (FIGS. 6 and 7A–7I) using either the same material or a different material as the halves 20*a*, 20*b*.

Figures 7G, 7H, 7I:
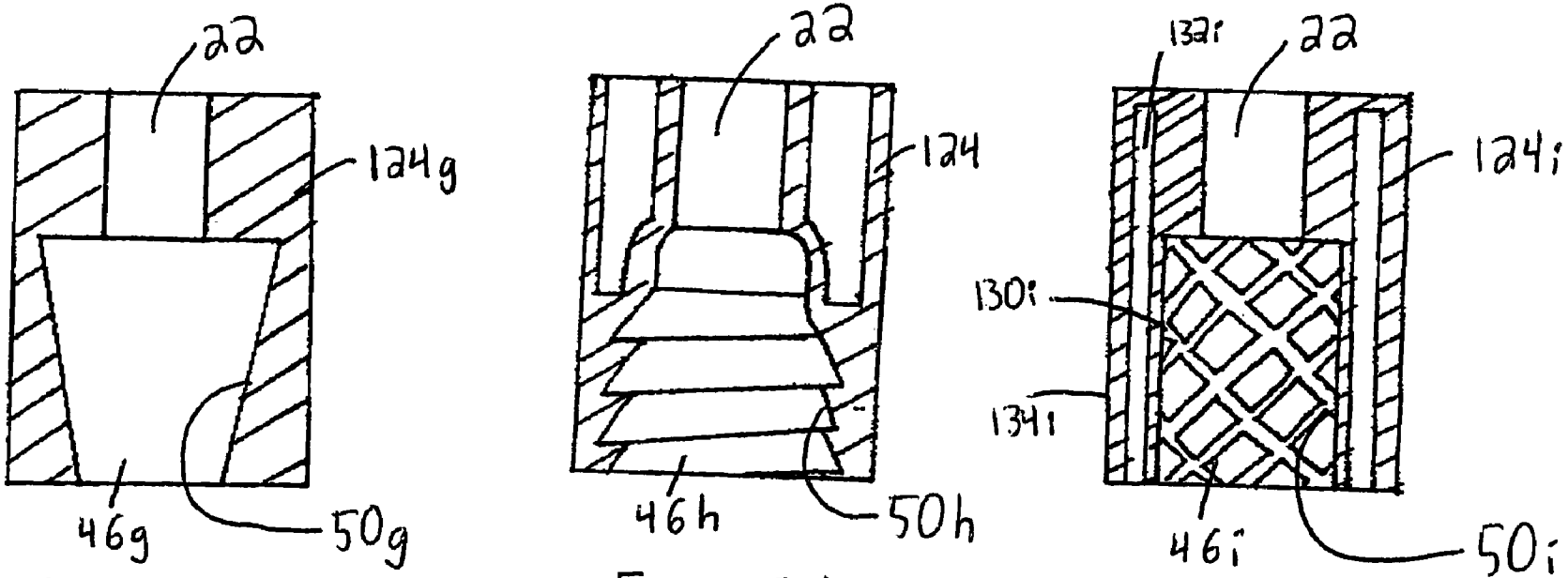

In the alternative the attachment means can be a smooth (i.e., without threads, flanges, ridges, or the like), tapered internal surface preferably made of a compliant material, such as PVC or another thermoplastic polymer that is suitable for food-grade containers, e.g., some of the various compliant styrene-based thermoplastic elastomers sold under the KRATON trademark that are suitable for food-grade containers, that accepts the threaded extension 46 of a tube 12. FIG. 7E shows an example of a tapered smooth surface 50*e* that can function as an attachment means. FIG. 7F shows an example of a non-tapered, smooth surface 50*f* that can function as an attachment means. FIG. 7G shows an example of an inverted-tapered smooth surface 50*g* that can function as an attachment means. The surfaces described in this paragraph can be, but need not necessarily be, integrally formed with the halves 20*a*, 20*b* of body 20 using either the same material or a different material, or separately formed via an attachment module (FIGS. 6 and 7A–7I) using either the same material or a different material as the halves 20*a*, 20*b*.

Various other configurations for tapered surfaces, stepped surfaces, non-tapered surfaces, and inverted-tapered surfaces might also be suitable as attachment means to attach to a threaded extension 46 of a tube of toothpaste (or some other paste or gel), including by way of example, but not of limitation, barbed surfaces 50*h* (e.g., that shown in FIG. 7H), texturally patterned surfaces 50*i* (e.g., that shown in FIG. 7I), surfaces having randomly distributed portions of extending material (not shown) surfaces having haphazardly distributed portions of extending material (not shown), surfaces having randomly distributed portions of extending material (not shown), etc. All of these alternative surfaces surface are preferably made of a compliant material, such as PVC or another thermoplastic polymer that is suitable for food-grade containers, e.g., some of the various compliant styrene-based thermoplastic elastomers sold under the KRATON trademark that are suitable for food-grade containers. The surfaces described in this paragraph can be, but need not necessarily be, integrally formed with the halves 20*a*, 20*b* of body 20 using either the same material or a different material, or separately formed via an attachment module (FIGS. 6 and 7A–7I) using either the same material or a different material as the halves 20*a*, 20*b*.

For all the various attachment means described above, a gasket material (not shown) can optionally be added to assist in forming an acceptable seal between the dispensing figurine 10 and the tube 12.

For the various attachment means described above, the figurine 10 is mated with the container 12 by fitting the threaded projection 46 into the body and twisting the figurine with respect to the container 12, so that their respective threads engage and attach the figurine to the container 12.

In the alternative, an attachment means having a movable portion (not shown) can be used. For example, an attachment means having a movable portion that takes at least two positions, in one "free" position allowing insertion and removal of threaded extension 46 and in the other "captured" position holding and preferably forming a seal with threaded extension 46. The attachment means comprising a movable portion is preferably biased into captured position, e.g., by a spring, so that firmly squeezing a fixed or movable region of body 20 puts the movable portion in the free position and releasing it allows the spring to put the movable position in the captured position.

As another alternative, an attachment means comprising an adhesive can be used. The container end 14 of the dispensing figurine preferably comprises a surface 56 (FIG. 4) that engages the surface 44 of the tube 12. The attachment means can comprise an adhesive (not shown) applied between the surface 54 of the figurine 10 and the surface 44 of tube 12. This adhesive preferably also forms a seal between the tube 12 and the figurine 10. In the alternative, a different seal, e.g., one of the structures described above, can be used to form a seal with the tube 12. The surface 54 is preferably frustoconical to match the frustoconical surface 44 of tube 12. Additionally, the surface 54 is preferably continuous so that contact with the tube surface 44 is made continuously around the threaded extension 46 of tube 12 so that adhesive can function to both attach and seal the figurine 10 and the tube 12.

Other common attachment means are known in the art and intended to come within the scope of the attachment means, including snap-on arrangements and all combinations and permutations of the various attachment means. It is preferred, however, that the attachment means used permits the dispensing figurine 10 to be easily attached, detached and reattached to the container 12. This facilitates re-use of the dispensing figurine 12 when the container 12 is empty, either by re-filling the container 12 or placing the figurine 10 on a different container.

As discussed above, the exterior of the body 20 of the dispensing figurine 10 preferably has the outward appearance of a being or a portion of a being. The exterior of the body 20 of the dispensing figurine 10 more preferably has the outward appearance of a head 60 and torso 62 of a being, with the attachment means, e.g., threaded, internal surface 50, positioned on the body 20 so that the tube 12 extends from the torso 62 and gives the appearance that the toothpaste tube is an additional portion of the being. Most preferably, the exterior of the body 20 of the dispensing figurine 10 has the outward appearance of a head 60 and torso 62 of a being, with the attachment means, e.g., threaded, internal surface 50, positioned on the body 20 so that the tube 12 extends from the torso 62 and gives the appearance that the toothpaste tube 12 is in approximately the position of and takes the place of one or more limbs (e.g., legs) of the being, as exemplified by FIGS. 1A, 2A, 3A, and 4. Thus, in a preferred embodiment, the dispensing figurine 10 represents only a portion of the represented being.

Figure 5:
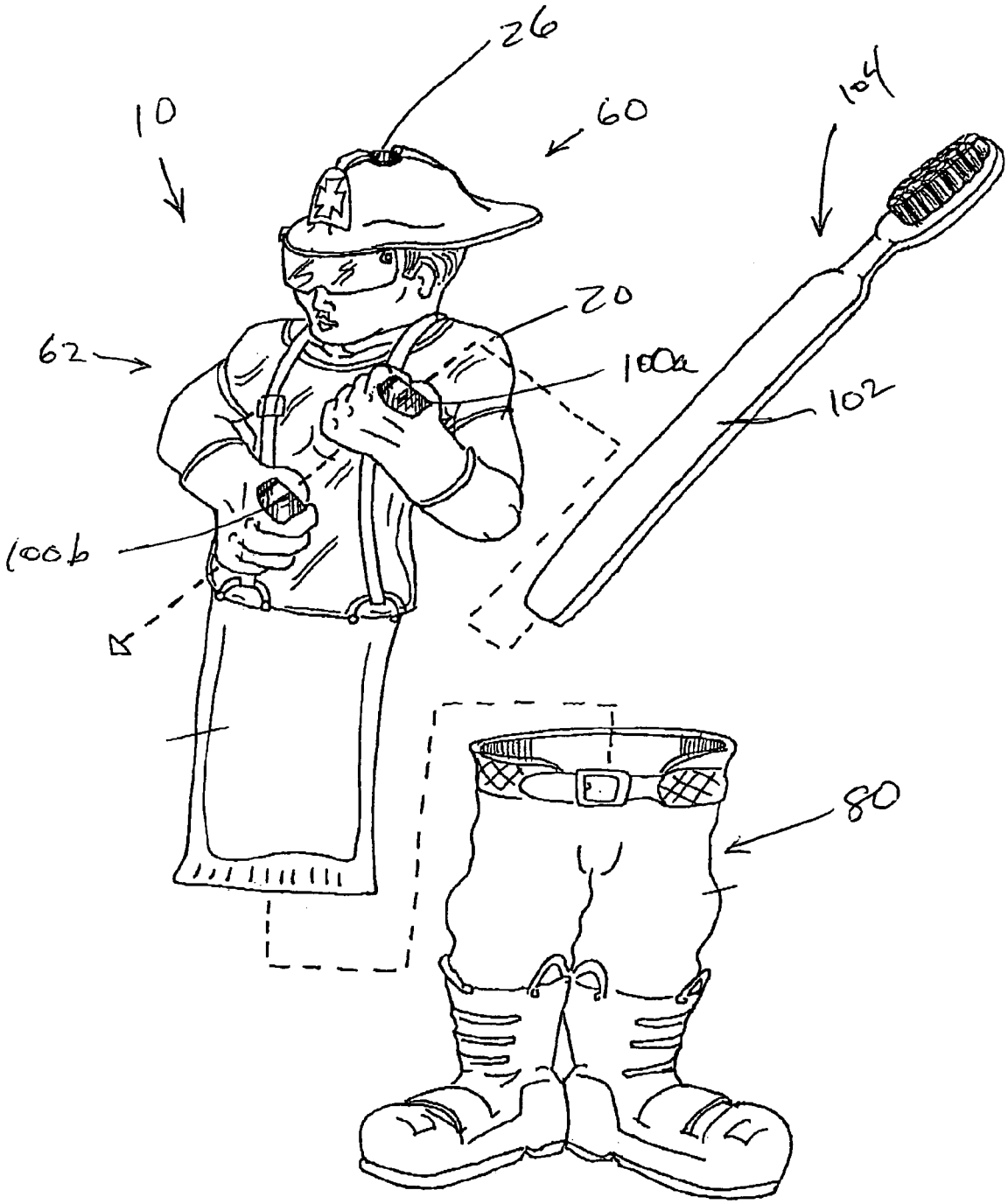
FIG. 5 is a perspective view of a fourth embodiment of the invention.

Alternatively, the figurine 10 may be used in conjunction with a bottom piece 80 such as illustrated in FIG. 5. In this embodiment, the portion of the container 12 extending away from the figurine 10 fits inside the bottom piece 80. The bottom piece 80 may attach to the figurine 10 by any conventional method, such as for example a threaded attachment (similar to the preferred attachment between the figurine 10 and the container 12). In the alternative, or in addition thereto, the figurine 10 and the bottom piece 80 might also include mating flanges (not shown) which allow a snap-on attachment. In the alternative, the dispensing figurine 10 can merely sit on the bottom piece 80, with the figurine 10 and attached tube 12 being easily lifted from the bottom piece 80. The external appearance of the bottom piece 80 preferably provides a remaining portion of the being partially represented by the body 20 of figurine 10, as shown in FIG. 5, where the bottom piece 80 has an outward appearance of the missing legs of the figurine 10 in FIG. 5. The bottom piece 80 (in conjunction with the dispensing figurine 10) preferably functions to permit the being to stand or to assume some other pose. In addition to providing sufficient room inside the bottom piece 80 to accommodate and conceal the remaining portion of the tube 12 not concealed by the figurine 10, the bottom piece can also be sized to provide sufficient space for other objects, such as a toothbrush, a comb, a package of dental floss, etc.

Figure 1C:
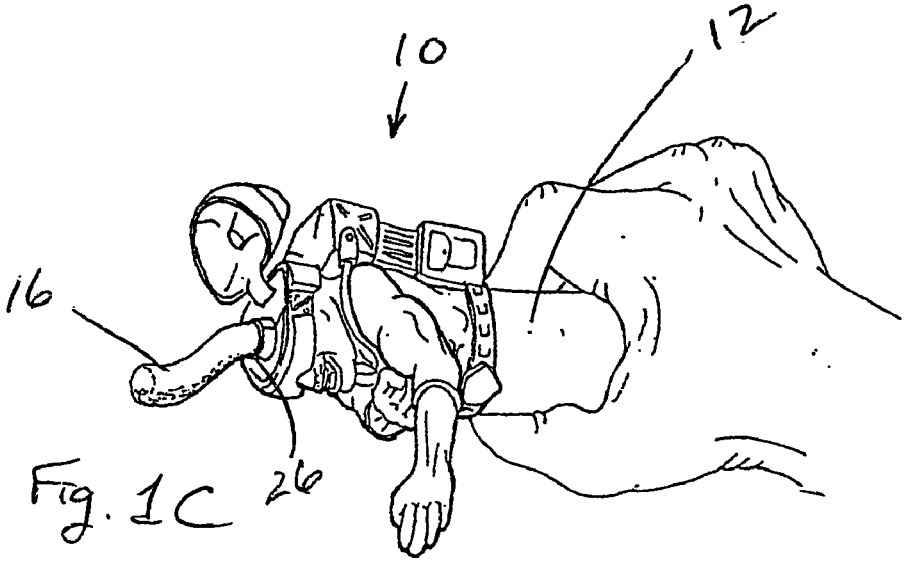
Figure 3C:
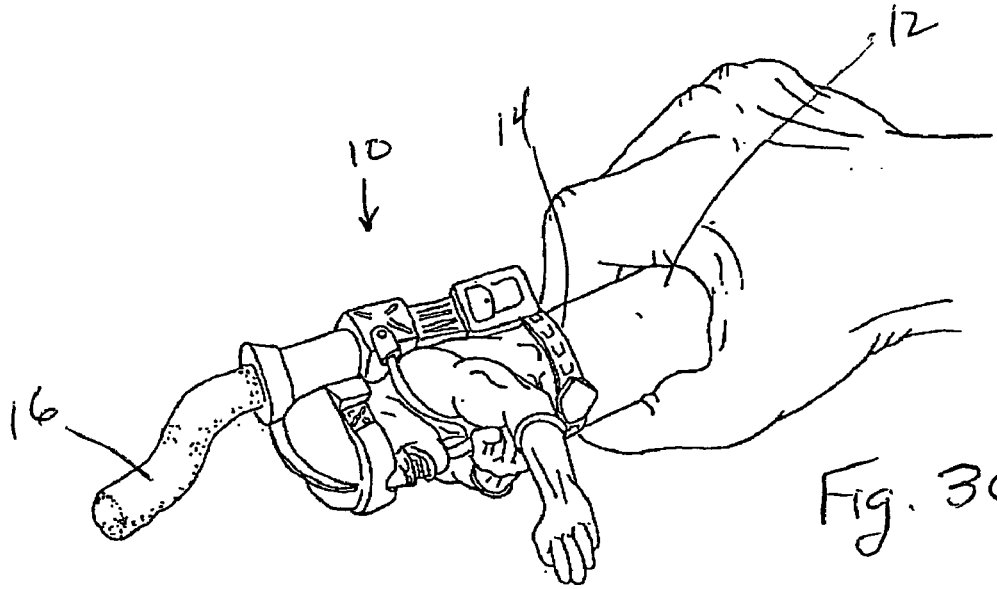

The dispensing figurine 10 may include moveable parts such as the rotatable arm 70 illustrated in FIGS. 1–3. The rotatable arm 70 preferably includes a generally circular insert 72 with an inside flange 74. Each of the two body halves 20*a*, 20*b* preferably has a corresponding hemispherical groove 76*a*, 76*b* which, when the halves 20*a*, 20*b* are affixed together, surround the insert 72. The flange 74 is thus caught inside the torso 62 of the figurine 10 by the grooves 76*a*, 76*b* such that the arm 70 is prevented from separating from the torso 62, but may rotate with respect thereto. FIG. 3A includes an arrow showing the direction of rotation for the arm 70 using the above-described means. Other means of providing moving parts are known in the art and suitable for the present invention, such as captive ball-in-sockets, etc. The represented being might also have a rotatable head, a removeable hat, or other such moveable parts. If a moveable part is employed, it is preferred that the permitted movement at least roughly mimic how the represented being might be expected to act. As further explained below, the moveable parts may provide a closure mechanism, or other functionality, in operation of the dispensing figurine 10.

The figurine 10 preferably comprises a closure mechanism 90, having a closed position and an open position. In the closed position, the closure mechanism preferably prevents the contents of the container 12 from exiting through the exit port 26. In the open position, the contents of the container 12 are free to be dispensed from or otherwise exit through the exit port 26. The closure mechanism may be part of the container 12, part of the figurine 10, or a separate element on its own, but preferably is part of or operates in conjunction with the figurine 10. If it is part of or operates in conjunction with the figurine 10, the closure mechanism may be located at or near the entry port 22 of the figurine 10, at or near the exit port 26 of the figurine 10, or anywhere in between; it is preferably located at the exit port 26. It may operate by any conventional means, such as a threaded screw top (e.g., a threaded, removable head or hat or apparel or other piece of the being, all not shown) covering the exit port 26 from the outside of the figurine 10.

There are two preferred closure mechanisms. The first, illustrated in FIG. 1, employs a flip-top as a closure mechanism. In this embodiment, the figurine 10 preferably includes a cover 92, which is preferably integrally formed with half 20*b* and hinged thereto with integral flexible hinge 93. The cover 92 preferably includes a cover projection 94, which extends down into the exit port when the cover 92 is closed. An extension 96 of the exit port 26 in FIG. 1 is helpful but not required; the cover projection 94 is preferably long enough to extend down into and form a seal with the extension 96 or some other portion of the exit port 26. Other seals will be apparent to those skilled in the art. The cover 92 may be held in its closed position, for example, by a cover flange along the inside rim of the cover 92 and an opposing flange on the main body 20 of the figurine 10.

The second preferred closure mechanism, illustrated in FIG. 3, employs a flexible tube 32 as the dispensing conduit 24 in the figurine 10. The tube 32 engages a tube channel 97 in an extended insert 98 of the rotatable arm 70. When the arm 70 is positioned on one position (e.g., the position illustrated in FIG. 3A), the contents of the container 12 are free to flow through the conduit 24 (tube 32) and exit through the exit port 26. If the arm 70 is rotated sufficiently far, the corresponding rotation of the insert 98 binds (e.g., pinches-off) the tube 32 such that the contents of the container 12 will be held in the container 12 and will not readily flow through the tube 32 to the exit port 26. Such rotation may occur in either the clockwise or counterclockwise direction. Preferably additional grooves 76*a*' and 76*b*' are provided on body halves 20*a*, 20*b*, respectively, to keep insert 98 in place. Preferably the insert 98 fits between the grooves tightly enough so that, when the arm is in the "closed" (pinched-off) position, the pressure from the contents in the tube does not cause the arm to rotate to the "open" position.

Virtually any closure mechanism suitable for toothpaste can be adapted into the body 20 of the dispensing figurine 10 according to the present invention, including by way of example but not of limitation any combination or permutation of the various closure mechanisms listed in the Background of the Invention hereof and those shown in FIGS. 1 and 3. Other closure mechanisms might also be adapted to the present invention, e.g., an aperture that functions as an iris.

Operation and use of the figurine 10 does not necessarily require a closure mechanism. The embodiments of FIGS. 2 and 5, for example, do not include a closure mechanism. The contents of the container in these embodiments are free to exit the container at any time. Therefore this embodiment is particularly useful when the container holds a paste or gel substance which is viscous enough to prevent it from exiting the container without pressure being applied to the container (as shown for example in FIG. 2C). In the alternative, the conduit 24 in these embodiments can be modified to include the type of known squeeze-type valves (not shown) in which pressure from the paste or gel 16 when squeezing tube 12 provides sufficient force to automatically open the valve and when the tube 12 is released, the valve is closed.

The body 20 of figurine 10 may also be characterized by being able to accept and removably retain an object external to the body 20 and/or the bottom piece 80, e.g., a toothbrush. For example, as illustrated in FIG. 5 the figurine 10 may include one or more toothbrush slots 100*a*, 100*b* into which the handle 102 of a toothbrush 104 may be placed. The toothbrush 104 may then be held by friction fit or interference fit within the toothbrush slots 100*a*, 100*b*. The toothbrush slots must surround the toothbrush only far enough that the toothbrush will remain in the toothbrush slots without external support. Preferably the toothbrush slots are incorporated as part of the being represented by the figurine 10 and located as part of the being that is used to hold an object. For example, in FIG. 5 they are incorporated as part of a fireman's hands.

In FIGS. 1, 2, 3, and 4, the various attachment means shown as having been molded integrally with the halves 20*a*, 20*b* of the body 20. FIG. 6 shows an alternative body half 120 that accepts any one of a number of different attachment modules (e.g., FIGS. 7A–7I) providing various attachment means. There will typically be two mating halves 120*a*, 120*b*, as discussed above in connection with halves 20*a*, 20*b*. The body halves 120*a*, 120*b* preferably have an opening 122 that accepts various attachment modules 124 shown in FIGS. 7A–7I. Of course, all of the other surfaces forming attachment means described herein can be embodied in a similar attachment module 124. In some of the attachment modules 124 (e.g., 124*b*, 124*d*, and 124), a wall 126 forming the surface 50 is the same wall 126 that forms outer surface 128 of the attachment module 124. In some of the other of the attachment modules 124 (e.g., 124*c*, 124*f*, and 124*i*), an inner wall 130 forming the surface 50 is separate from and spaced via space 132 from an outer wall 134 that forms outer surface 128 of the attachment module 124. This space 132 provides room for the inner wall 130 and thus surface 50 to flex when receiving threaded portion 46 of a tube 12. The remainder of the attachment modules 124 (e.g., 124*b* and 124*h*) are essentially a hybrid of the two foregoing exemplary structures, having both a wall 126 forming part of the surface 50 that is the same wall 126 that forms part of outer surface 128 of the attachment module 124 and an inner wall 130 forming the other part of the surface 50 that is separate from and spaced via space 132 from an outer wall 134 that forms the rest of outer surface 128 of the attachment module 124, with the space 132 providing room for the inner wall 130 and thus surface 50 to flex when receiving threaded portion 46 of a tube 12. In FIG. 7I, the inner wall 130*i* is connected to the outer wall 134*i* at the top of the structure shown in that Figure. In FIG. 7F, the inner wall 130*f* is connected to the outer wall 134*f* at the bottom of the structure shown in that Figure. Other connection points are possible. One of the various attachment modules 124 are held in the opening 122 in the halves 102*a*, 120*b*, e.g., with adhesive, by ultrasonic welding, or by the halves 120*a*, 120*b* trapping and holding the module 124 in place therebetween.

While a preferred embodiment of the invention has been disclosed in detail, the present invention is not to be considered limited to the precise modules and module arrangements disclosed herein. Various adaptations, modifications and uses of the invention may occur to those skilled in the art to which the invention relates, and the invention is to cover all such adaptations, modifications and uses falling within the spirit and scope of the following claims. For example, although the various figurines 10 are shown as being formed of two body halves 20*a*, 20*b*, or 120*a*, 120*b*, the body 20 of the various dispensing figurines 10 according to the present invention can be formed in a single integral unit, or formed from three or more portions, with or without a separate attachment module 124. Similarly, although the various figurines 10 are shown as having an attachment means being formed at a joining point of two body halves 20*a*, 20*b*, or 120*a*, 120*b*, the attachment means can be formed on virtually any portion of the body 20, e.g., by locating the opening 122 at various other locations and by routing the conduit 24 accordingly. While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

I claim:

1. A toothpaste dispensing figurine that permits toothpaste to be dispensed from a toothpaste container, comprising:

a) a body formed in the image of a portion of a being;

b) a container end of said body which may be attached, detached and reattached to the container of toothpaste, said container of toothpaste comprising a crimped-end tube; and c) a dispensing conduit extending through at least a portion of said body, having an entry port allowing ingress of the toothpaste and an exit port allowing the toothpaste to be dispensed through at least a portion of the body;

d) wherein toothpaste may be dispensed from the container by a squeezing pressure being applied to the crimped-end tubes;

e) a closure mechanism that prevents the toothpaste from readily being dispensed; and f) the dispensing conduit comprises a flexible tube, the closure mechanism comprises a rotatable insert having an inside portion and an outside portion, the tube passes through a channel in the inside portion of the rotatable insert, with the inside portion pinching off the flow of toothpaste through said tube while in a first position and permitting toothpaste to flow through said tube in a second position, and said rotatable insert characterized by a user being able to rotate the inside portion between the first and second positions using the outside portion.

2. The toothpaste dispensing figurine of claim 1 wherein said outside portion comprises a limb of said being.

3. The toothpaste dispensing figurine of claim 1 wherein said body has the outward appearance of a head and torso of the being and said container end is positioned on said body so that the toothpaste container extends from the torso and gives the appearance that the toothpaste container is an additional portion of the being.

4. The toothpaste dispensing figurine of claim 1 wherein said body has the outward appearance of a head and torso of the being and said container end is positioned on said body so that the toothpaste container extends from the torso and gives the appearance that the toothpaste container is in approximately the position of and takes the place of one or more limbs of the being.

5. The toothpaste dispensing figurine of claim 1 further comprising a bottom piece that engages a portion of said body, wherein said body conceals at least a portion of the toothpaste container, and wherein said bottom portion conceals a portion of the remaining portion of the toothpaste container not concealed by said body.

6. The toothpaste dispensing figurine of claim 5 wherein said bottom piece is sized to provide sufficient space for other objects in addition to a portion of the toothpaste container.

7. The toothpaste dispensing figurine of claim 1 further comprising a bottom piece that engages a portion of said body, wherein said body conceals at least a portion of the toothpaste container, and wherein said bottom portion conceals a remaining portion of the toothpaste container not concealed by said body.

8. The toothpaste dispensing figurine of claim 7 wherein said bottom piece is sized to provide sufficient space for other objects in addition to a portion of the toothpaste container.

9. The toothpaste dispensing figurine of claim 1 further comprising at least one opening on the exterior of said figurine for holding an object.

10. The toothpaste dispensing figurine of claim 1 further comprising at least one opening on the exterior of said figurine for holding a toothbrush.

11. The toothpaste dispensing figurine of claim 1 wherein said container end comprises attachment means for attaching said body to the toothpaste container.

12. The toothpaste dispensing figurine of claim 1 wherein said being is one of the following: an action figure, a person, a historical figure, a sports personality, an animal, a fictional character, or a fictional creature.

* * * * *